US007108491B2

(12) United States Patent
Ganser

(10) Patent No.: US 7,108,491 B2
(45) Date of Patent: Sep. 19, 2006

(54) HIGH PRESSURE PUMP

(75) Inventor: Marco Ganser, Oberägeri (CH)

(73) Assignee: Ganser-Hydromag AG, (CH)

( * ) Notice: Subject to any disclaimer, the term of this patent is extended or adjusted under 35 U.S.C. 154(b) by 0 days.

(21) Appl. No.: 10/544,004

(22) PCT Filed: Dec. 4, 2003

(86) PCT No.: PCT/CH03/00802

§ 371 (c)(1),
(2), (4) Date: Aug. 1, 2005

(87) PCT Pub. No.: WO2004/072477

PCT Pub. Date: Aug. 26, 2004

(65) Prior Publication Data

US 2006/0062677 A1 Mar. 23, 2006

(30) Foreign Application Priority Data

Feb. 11, 2003 (CH) ..... 202/03

(51) Int. Cl.
*F04B 1/053* (2006.01)
*F04B 53/18* (2006.01)

(52) U.S. Cl. ..... 417/470; 92/72; 92/159

(58) Field of Classification Search ..... 92/72, 92/158, 159; 184/6.6; 417/228, 470
See application file for complete search history.

(56) References Cited

U.S. PATENT DOCUMENTS 5,979,297 A * 11/1999 Ricco ..... 417/470
6,077,056 A 6/2000 Gmelin
6,183,212 B1 2/2001 Djordjevic (Continued)

FOREIGN PATENT DOCUMENTS

DE 197 05 205 8/1998

(Continued)

OTHER PUBLICATIONS

English Abstract of DE 197 05 205.

(Continued)

*Primary Examiner*—Michael Koczo, Jr.
(74) *Attorney, Agent, or Firm*—Hershkovitz & Associates; Abe Hershkovitz

(57) ABSTRACT

A piston (6) of a piston pump unit (2), which can be displaced in a translatory manner, is guided in a cylinder bore (7). The piston (6) is driven by a crank drive (13) comprising an eccentric element (15) which is arranged on a drive shaft (14). A stroke ring (12) is rotationally mounted on the eccentric element (15) but does not rotate therewith. A sliding surface (10) of the piston (6) is arranged on a sliding bearing surface (11) on the stroke ring (12). A discharge chamber (22) is embodied inside the piston (6) on an end opposite the stroke ring (12). Said discharge chamber is open towards the sliding bearing surface (11). The discharge chamber (22) is connected in a pressure-wise manner to a working chamber (8) by means of a passage (23) in the piston (6). A displaceable control piston (25) is guided in a longitudinal bore (24) pertaining to said passage (23). Said control piston (25) is impinged upon on one side by a medium in the working chamber (8) and on the other front side by a pressure medium in the discharge chamber (22). The control piston (25) separates the medium which is to be transported from the pressure medium in the discharge chamber (22) and ensures that the pressure in the discharge chamber (22) increases if the pressure increases in the working chamber (8). This results in decompression of the sliding bearing between the piston (6) and the stroke ring (12).

20 Claims, 5 Drawing Sheets

U.S. PATENT DOCUMENTS

Figure 1:
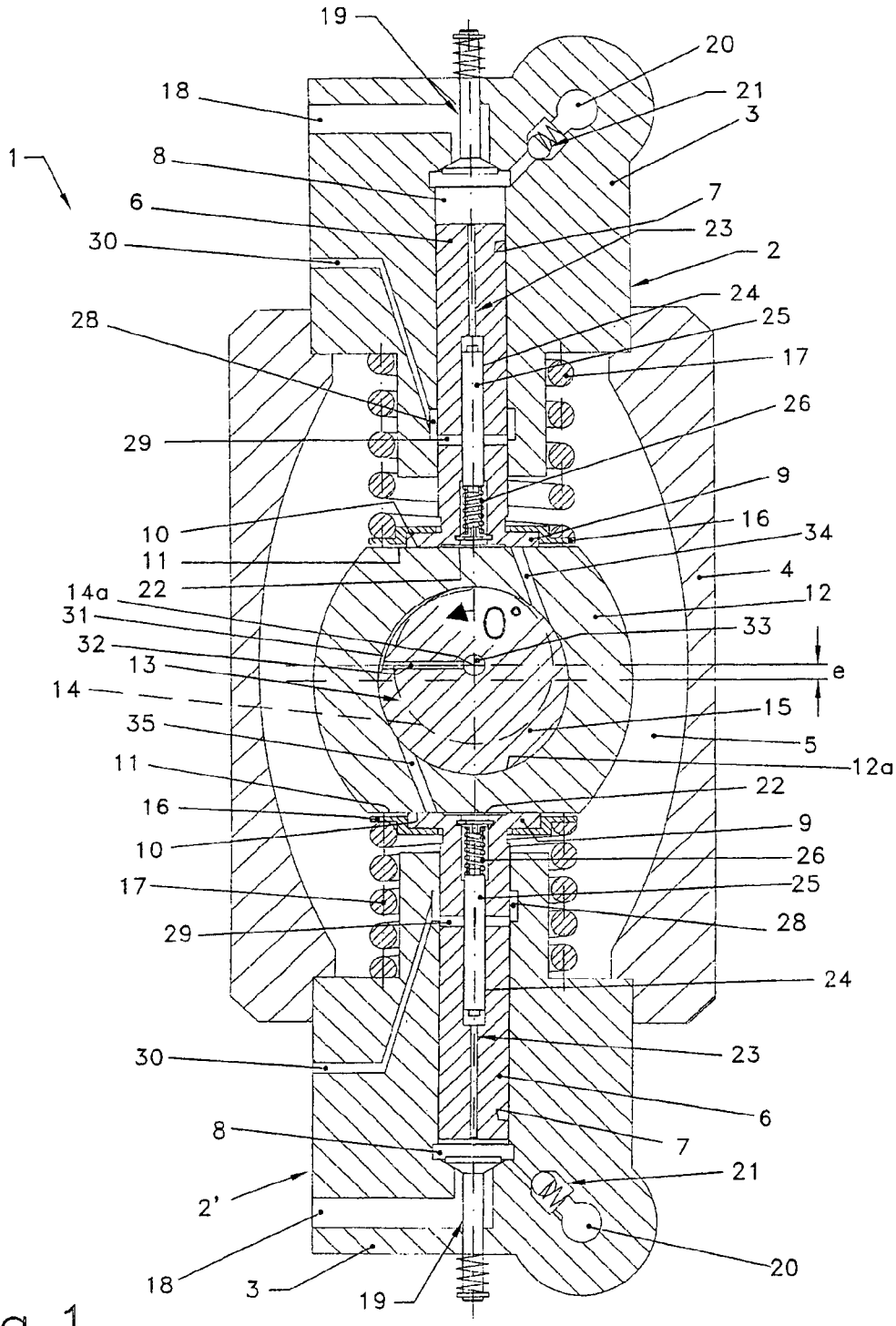

| | | | | |
|---|---|---|---|---|
| 6,250,893 | B1 * | 6/2001 | Streicher | 417/470 |
| 6,889,665 | B1 * | 5/2005 | Rembold | 417/228 |
| 6,910,407 | B1 * | 6/2005 | Furuta | 92/72 |
| 2004/0136837 | A1 | 7/2004 | Ganser et al. | |
| 2004/0156733 | A1 | 8/2004 | Spinnler | |

FOREIGN PATENT DOCUMENTS

| | | |
|---|---|---|
| DE | 197 56 727 | 5/1999 |
| DE | 102 13 625 | 12/2002 |

OTHER PUBLICATIONS

English Abstract of DE 197 56 727.

English Abstract of DE 102 13 625.

* cited by examiner

HIGH PRESSURE PUMP

The invention relates to a high pressure pump which is suitable in particular for use in a fuel injection system for internal combustion engines.

The invention relates to a high pressure pump according to the preamble of claim 1, which is suitable in particular for use in a fuel injection system for internal combustion engines.

In DE-A-197 05 205 and the corresponding U.S. Pat. No. 6,077,056, a generic high pressure pump for a fuel injection device for internal combustion engines is described in which the piston of a piston pump unit is driven harmonically by an eccentric drive. At its end facing away from the working chamber of the piston pump unit, the piston bears a sliding shoe which rests with a sliding surface against a sliding bearing surface of a stroke ring. The stroke ring is rotatably mounted on an eccentric journal of a drive shaft and is driven rotatably but does not rotate. The drive shaft, the eccentric journal, the stroke ring and the sliding shoe are all accommodated in a low pressure chamber, which is used as a feed chamber for the medium to be delivered, that is to say fuel. Formed in the sliding shoe is a relief chamber, which is open toward the sliding bearing surface and has a direct hydraulic connection to the working chamber via a passage which extends in the longitudinal direction of the pump piston. The relief chamber is accordingly filled with the fuel to be delivered.

During the delivery stroke of the piston pump unit, the piston and the sliding shoe fixed to the latter are pressed against the stroke ring by the pressure acting in the working chamber. At the same time, there is also an increase in the pressure in the relief chamber connected to the working chamber, as a result of which the force acting on the sliding shoe and directed away from the stroke ring is increased. Relief of the load on the sliding bearing between the sliding shoe and the stroke ring is therefore achieved. This hydrostatic relief of the load on the sliding bearing leads to a reduction in the friction between the sliding surface on the sliding shoe and the sliding bearing surface on the stroke ring.

The lubrication of the sliding bearing between the sliding shoe and the stroke ring is carried out by the fuel in the relief chamber. The bearing between the eccentric journal and the stroke ring is lubricated by the fuel in the low pressure chamber. However, as is known, fuel has poor lubricating properties and is therefore able to develop only a restricted lubricating action.

The present invention is, then, based on the object of providing a high pressure pump of the type mentioned at the beginning for very high delivery pressures and large delivery quantities, whose production costs are as low as possible and which is able to satisfy high requirements on the operational reliability and on the lifetime.

This object is achieved by a high pressure pump having the features of claim 1.

The relief chamber is divided off from the working chamber by the pressure transmission element arranged in the passage in the piston. Therefore, the medium to be delivered, which is fuel, for example, is also separated from the medium in the relief chamber. There is thus no longer any restriction to using the medium to be delivered for the pressure relief and the lubrication of the sliding bearing between the stroke ring and the piston. Instead, a medium which is much more suitable for these tasks can be chosen, which means one with excellent lubricating properties, for example lubrication oil. With the considerably improved lubrication of the sliding bearing and also the bearing between the stroke ring and the crank drive, the risk of these bearings seizing, even under high loading, is reduced sharply, which in turn contributes to increased operational reliability and a long lifetime.

Since the pressure transmission element is pressurized on one side by the medium to be delivered and can be displaced in the direction of the application of pressure, the pressure in the working chamber is transmitted to the medium in the relief chamber, that is to say, when the pressure in the working chamber rises, the pressure in the relief chamber also rises. Therefore, relief of the load on the sliding bearing between stroke ring and piston is achieved which becomes greater as the delivery pressure becomes greater, as is known from the aforementioned prior art. This relief of the load on the sliding bearing not only permits higher delivery pressures but also allows an enlargement of the piston area and therefore an increase in the delivery rate without the number of piston pump units necessarily having to be increased for this purpose. This has a beneficial effect on the production costs.

Preferred further refinements of the high pressure pump according to the invention form the subject matter of the dependent claims.

Figure 2:
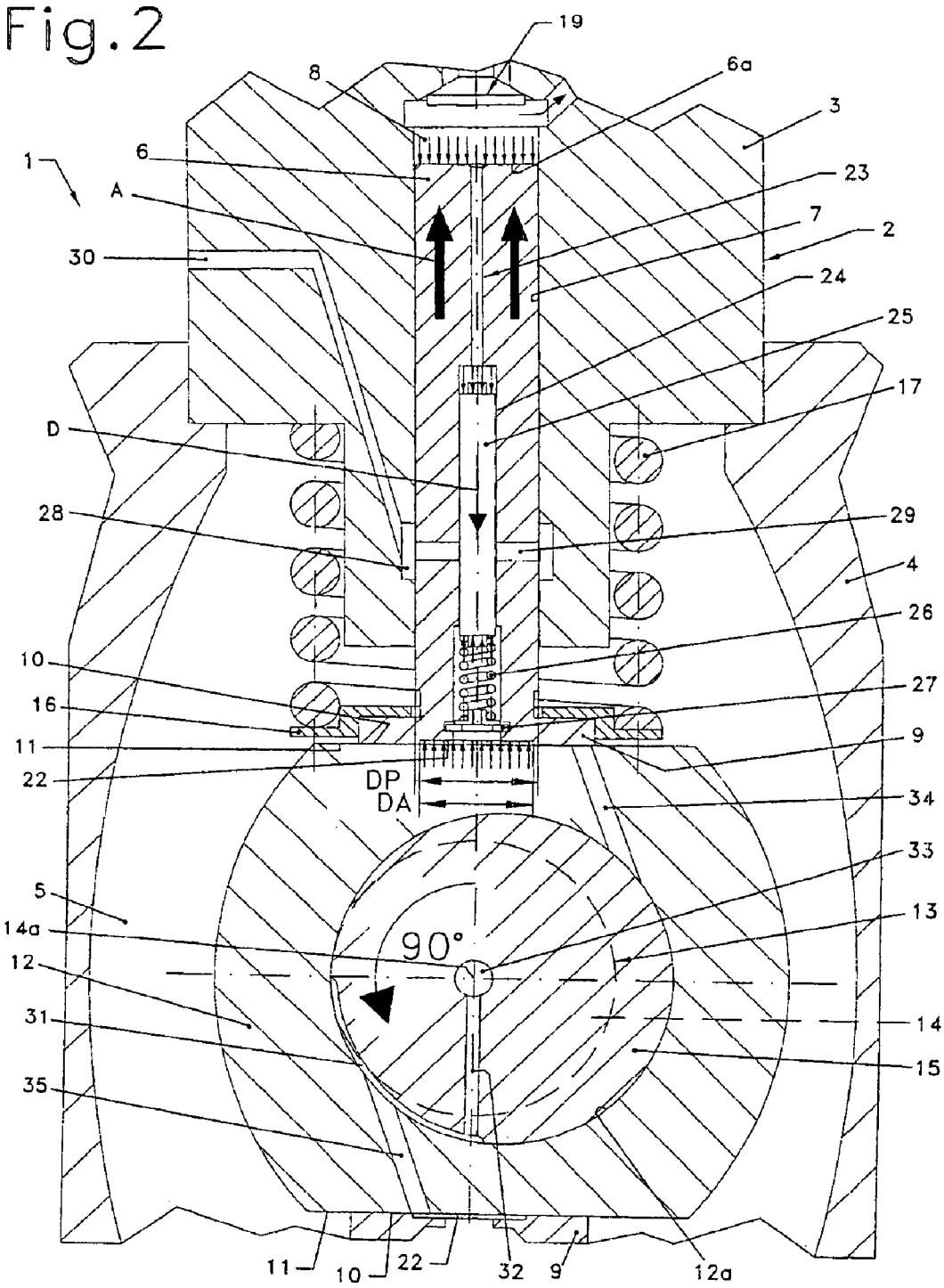
Figure 3:
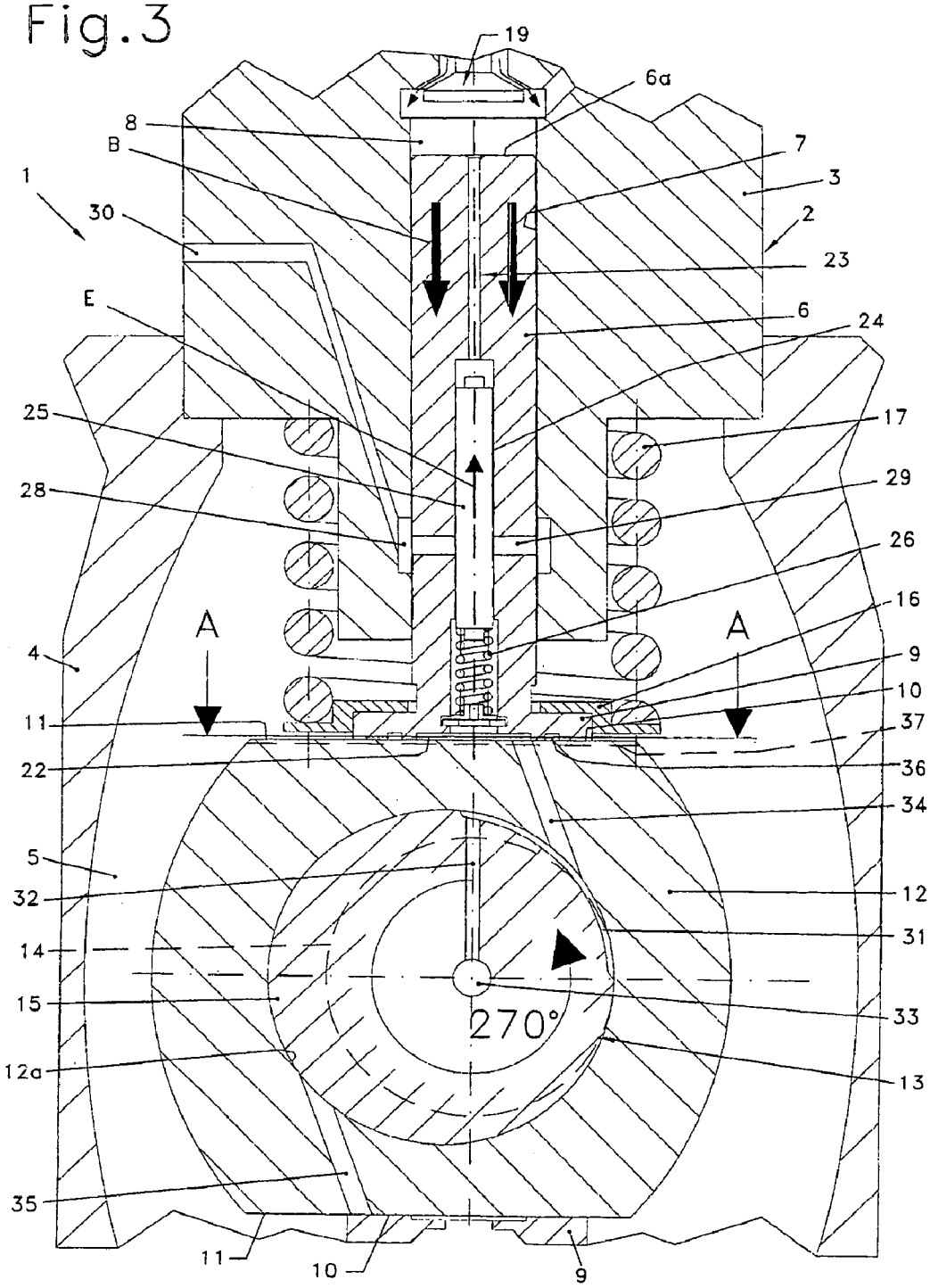
Figure 4:
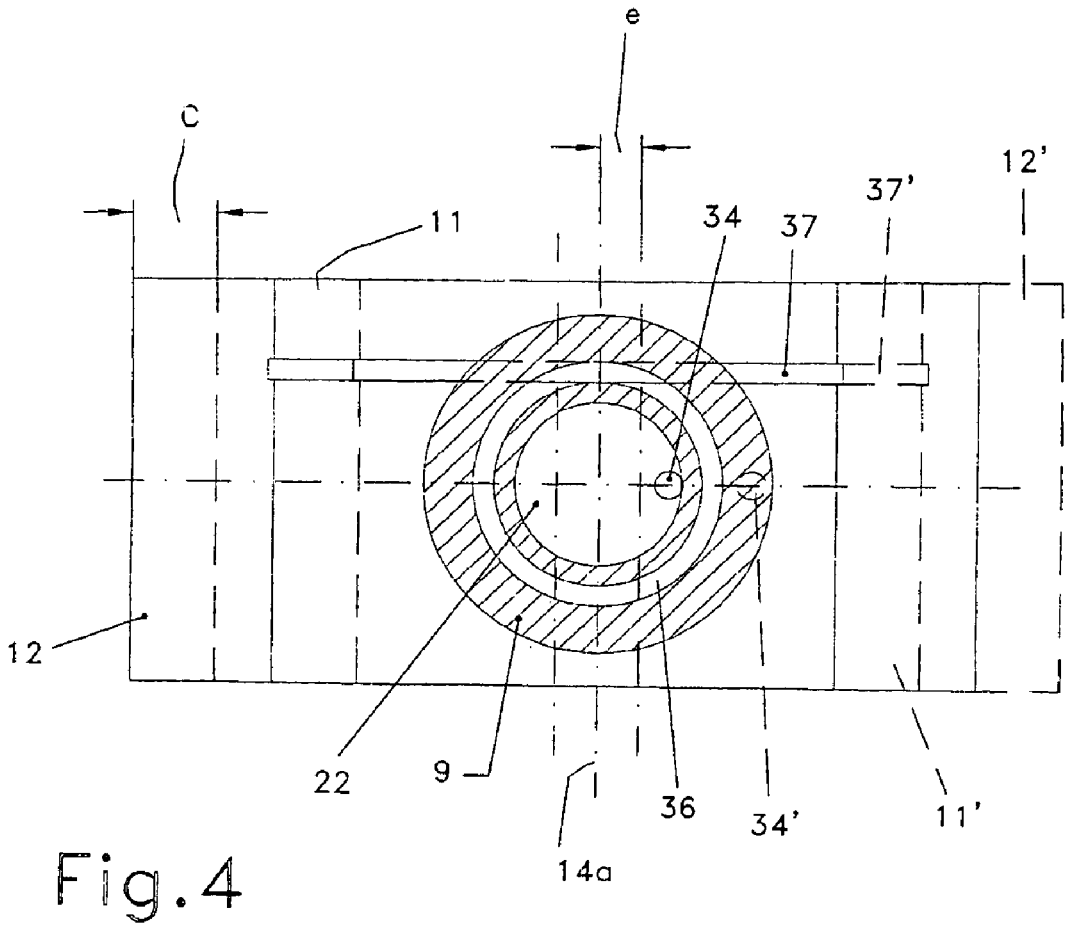
Figure 5:
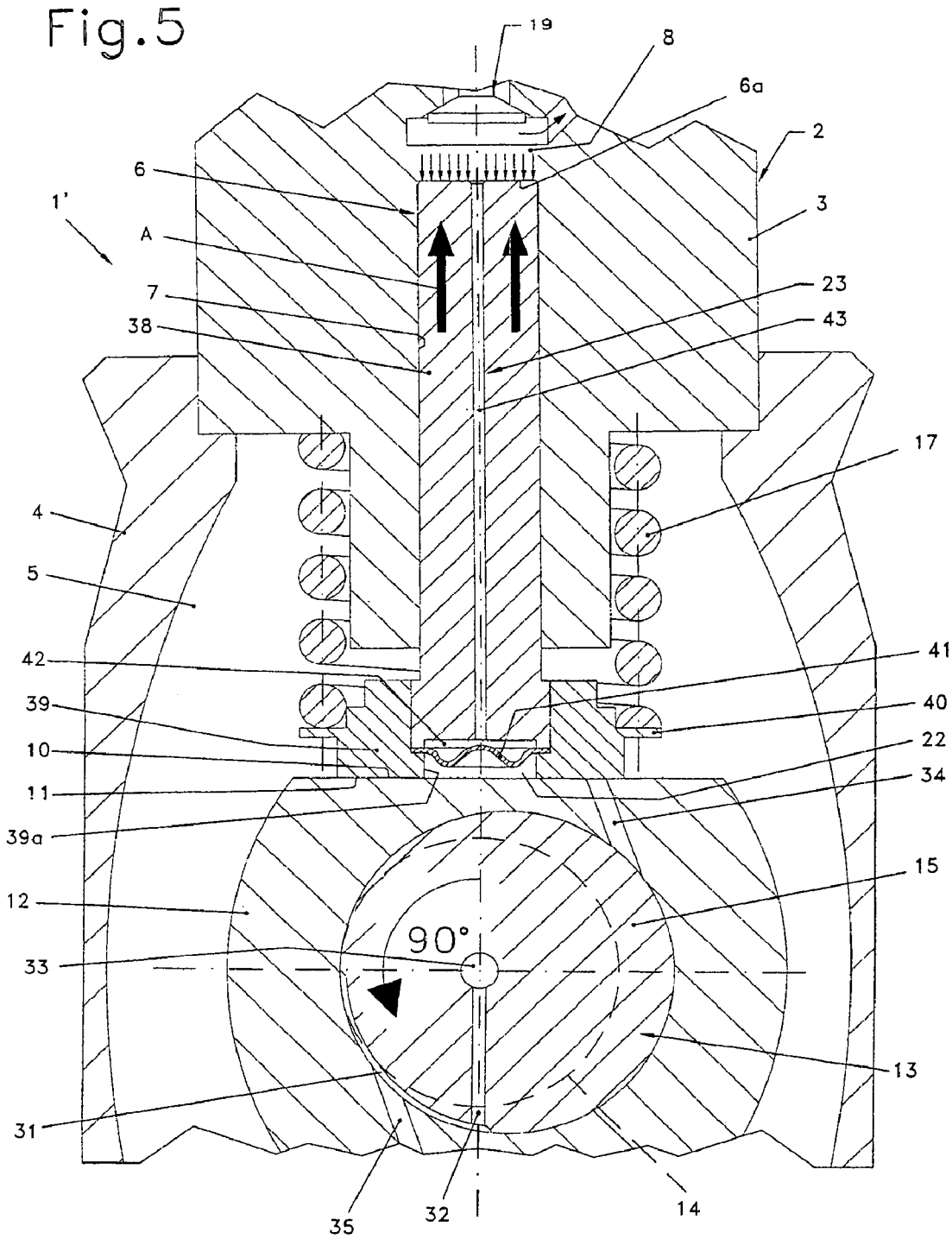

In the following text, by using the drawings, exemplary embodiments of the subject matter of the invention will be explained in more detail. In the drawings, purely schematically:

FIG. 1 shows a first embodiment of a high pressure pump having two piston pump units, in a longitudinal section, FIGS. 2 and 3 show one of the two piston pump units with the pump piston in various operating positions, in an illustration corresponding to FIG. 1 and on an enlarged scale, FIG. 4 shows a section along the line A—A in FIG. 3, and FIG. 5 shows a second embodiment of a high pressure pump in an illustration corresponding to FIG. 2.

The high pressure delivery pump 1 shown in FIGS. 1–4, which is intended for use in a fuel injection system for internal combustion engines, has two mutually diametrically opposite piston pump units 2, 2' (plunger pump units), which are constructionally identical and operate in antiphase. Each piston pump unit 2, 2' has a housing block 3, which is firmly connected to a pump casing 4 and projects into the interior 5 of this pump casing 4. Each piston pump unit 2, 2' has a piston 6 (plunger), which is guided such that it can move linearly with a close sliding fit in a cylinder bore 7 in the housing block 3. With one end face 6*a*, the piston 6 delimits a working chamber 8 and, at its opposite end, widens to form a base part 9. This base part 9 has a flat sliding surface 10, which rests on a sliding bearing surface 11 which is provided on a stroke ring 12. This stroke ring 12 is common to both piston pump units 2, 2'. Provided for the harmonic drive of the pistons 6 of the two piston pump units 2, 2' is a crank drive 13, which has a drive shaft 14, illustrated dashed, and an eccentric element 15 firmly connected to the latter. The drive shaft 14 is driven in rotation about its axis of rotation 14*a* (FIG. 1). The stroke ring 12 is seated rotatably but not so as to corotate on the eccentric element 15. The eccentric element 15 is arranged with an eccentricity e (FIG. 1) with respect to the axis of rotation 14*a* of the drive shaft 14. During rotation of the drive shaft 14, the stroke ring 12 is moved firstly parallel to the sliding bearing surfaces 12 and secondly at right angles to the axis of rotation 14*a* of the drive shaft 14, specifically by the amount 2*e* in each direction. During operation, the stroke ring 12 is thus displaced to and fro with respect to the base part 9 of the piston 6. The pistons 6 of the piston pump units 2, 2' execute a stroke which is likewise 2*e*, that is to say twice the eccentricity e.

Seated on the base part 9 of the piston 6 is a bearing ring 16, which is used as an abutment for a compression spring 17 which is supported at the other end on the housing block 3. The compression spring 17 keeps the associated piston 6 in continuous contact with the stroke ring 12.

Formed in the housing block 3 is an inlet conduit 18, which is connected to the working chamber 8 via a pressure-controlled inlet valve 19 (FIG. 1). The inlet conduit 18 is connected to a feed line, not illustrated, which is connected to a liquid reservoir, that is to say in the present case to a fuel tank, for example via a pre-delivery pump. In the housing block 3 there is also an outlet conduit 20, which is connected to the working chamber 8 via a pressure-controlled outlet valve 21 (FIG. 1). The outlet conduit 20 is connected to a high pressure chamber, for example the common rail of a fuel injection system.

Formed in the region of the sliding surface 10 in the base part 9 of the piston 6 is a relief chamber 22, which is open toward the sliding bearing surface 11. In the longitudinal direction of the piston 6 there extends a continuous, coaxial passage 23, which on one side is open toward the working chamber 8 and on the other side is open toward the relief chamber 22 (the passage 23 could also be placed off-axis). Belonging to this passage 23, whose diameter changes, is a longitudinal bore 24, in which a control piston 25, which serves as a pressure transmission element, is displaceably guided with a close sliding fit. The control piston 25 rests on a compression spring 26, which is supported at the other end on a spring ring 27 (FIG. 2), which is retained in the piston 6.

Formed in the housing block 3 is an annular groove 28, which extends around the piston 6 and is open toward the cylinder bore 7. In the piston 6 there is a transverse bore 29, which passes through the piston 6 and which is connected to the annular groove 28 at both ends. Connected to the annular groove 28 is a discharge conduit 30, which extends in the housing block 3 and which is connected to a return line, not shown, which leads to a collecting reservoir, which can be the fuel tank. Seepage, which is fed back via the discharge conduit 30, collects in the annular groove 28 in a manner still to be described.

The eccentric element 15 is provided with a lubricating groove 31, which extends along a part of the circumference and is open toward the stroke ring 12. The lubricating groove 31 is connected via a radial bore 32 in the eccentric element 15 to a feed duct 33, which extends in the direction of the axis of rotation 14*a* of the drive shaft 14 and which is connected to a lubricant reservoir via a lubricant pump, not shown. Via this feed duct 33, a lubricant, preferably lubricating oil, is supplied at a pressure of, for example, 2–6 bar. Formed in the stroke ring 12 are two connecting ducts 34, 35, each of which leads from the inner surface 12*a* of the stroke ring 12 to one of the sliding bearing surfaces 11. The lubricating groove 31, which is permanently connected to the feed duct 33, is, however, connected to a connecting duct 34, 35 only in specific rotational positions of the eccentric element 15, as can be seen from FIGS. 1–3.

The functioning of the high pressure pump 1 will now be described in more detail by using FIGS. 1–4.

FIG. 1 shows that rotational position of the eccentric element 15 in which the piston 6 of the one piston pump unit 2, the upper one in the figures, is located in the lower end position, that is to say at the end of the suction stroke. The piston 6 of the other, lower piston pump unit 2' has reached the end of the delivery stroke and therefore its upper end position. The connecting ducts 34, 35 are connected neither to the lubricating groove 31 nor to the associated relief chamber 22.

Starting from this initial position, only the operation of the upper piston pump unit 2 will be described below. The operation of the other, lower piston pump unit 2' is equal but opposite.

If the drive shaft 14 rotates in the counterclockwise direction, then the delivery stroke begins for the piston 6 of the upper piston pump unit 2, that is to say the piston 6 will be displaced upward in the direction of the arrow A (FIG. 2). During this delivery stroke, the inlet valve 19 is closed, which also applies to the outlet valve 21 at the beginning of the delivery stroke. The pressure in the working chamber 8 rises, the control piston 25, which is pressurized on its end face facing the working chamber 8 by the pressure of the liquid in the working chamber 8, is moved downward in the direction of the arrow D in FIG. 2, counter to the action of the compression spring 26. The result of this is that the pressure of the lubricant which is located in the relief chamber 22 and in the region of the passage 23 underneath the control piston 25 is increased. As a result, a force is exerted on the piston 6 which is directed away from the stroke ring 12 and which counteracts the force exerted on the piston 6 by the liquid in the working chamber 8. In this way, hydrostatic relief of the load on the sliding bearing formed by the sliding surface 10 on the base part 9 and the sliding bearing surface 11 on the stroke ring 12 is achieved, as described in DE-A-197 05 205 and U.S. Pat. No. 6,077,056 already mentioned. An optimum relief action is achieved when the diameter DA of the relief chamber 22 is slightly smaller than the diameter DP of the end face 6*a* of the piston 6 which faces the working chamber 8 (see FIG. 2).

The situation following a rotation of the drive shaft 14 through 90° is illustrated in FIG. 2. The piston 6 has reached its middle position during the delivery stroke. There is no connection between the lubricating groove 31 and the relief chamber 22 of the upper piston pump unit 2. By contrast, in the lower piston pump unit 2', not shown, the relief chamber 22 is connected to the lubricating groove 31. After the rotation of the drive shaft 14 through 90°, illustrated in FIG. 2, the stroke ring 12 assumes its right-hand end position, which is illustrated dashed in FIG. 4 and is designated 12'.

As soon as the pressure in the working chamber 8 in the course of the delivery stroke of the piston reaches a value which is greater than the closing force of the outlet valve 21, the latter is opened and the liquid is expelled from the working chamber 8 into the outlet conduit 20 and then into the high pressure chamber.

Following a rotation of the drive shaft 14 through 180° from the position shown in FIG. 1, the delivery stroke of the piston 6 is completed. The piston 6 is then moved downward in the opposite direction, that is to say in the direction of the arrow B (FIG. 3), for the suction stroke. During this suction stroke, the outlet valve 21 remains closed. During the downward movement of the piston 6 in the direction of the arrow B, a negative pressure is produced in the working chamber 8, which results in the inlet valve 19 opening and allowing liquid to flow into the working chamber 8. The pressure prevailing in the relief chamber 22 and the region of the passage 23 underneath the control piston 28, together with the compression spring 26, effects upward displacement of the control piston 25 in the direction of the arrow E (FIG. 3). The situation following the rotation of the drive shaft 14 through a total of now 270° is illustrated in FIG. 3. The piston 6 has reached its middle position during the suction stroke. The stroke ring 12 now assumes its left-hand end position, which is illustrated by continuous lines in FIG. 4. This FIG. 4 reveals that the stroke ring 12 executes a total stroke C in the direction of the sliding bearing surface 11 which is equal to 2e, that is to say twice the eccentricity e. In this left-hand end position of the stroke ring 12, shown in FIGS. 3 and 4, the connecting duct 34 in the stroke ring 12 is now connected to the relief chamber 22 and the lubricating groove 31. This means that pressurized oil can get into the relief chamber 22 via the feed duct 33, the radial bore 32, the lubricating groove 31 and the connecting duct 34. In this way, the lubricant which has been lost during the delivery stroke as a result of leakage along the sliding bearing surface 11 and along the outer surface of the control piston 25 is replaced.

Following a rotation of the drive shaft 14 through a total of 360°, the piston 6 is located at the end of the suction stroke and assumes the lower end position illustrated in FIG. 1 again. The operating cycle described starts from the beginning.

Although the piston 6 is guided in the cylinder bore 7 with a close sliding fit, on the one hand liquid, that is to say fuel, can pass through the gap between the piston 6 and the wall of the cylinder bore 7 and, on the other hand, lubricant, that is to say lubricating oil, can pass out of the interior 5 of the pump casing 4. This seepage is collected in the annular groove 28 as a liquid-lubricant mixture, that is to say as a fuel-lubricating oil mixture.

In addition, it is possible that liquid (fuel) can pass out of the working chamber 8 via the upper section of the passage 23 and through the very small gap between the control piston 25 and the wall of the longitudinal bore 24. This seepage likewise passes into the annular groove 28 via the transverse bore 29 in the piston 6. Furthermore, lubricant (lubricating oil) from the relief chamber 22 can pass through the narrow gap between the control piston 25 and the wall of the longitudinal bore 24. This leakage lubricant likewise passes into the annular groove 28 via the transverse bore 29.

The mixture of liquid (fuel and lubricant (lubricating oil)) in the annular groove 28 is led away via the discharge conduit 30 and, for example, led back into the liquid reservoir, that is to say the fuel tank.

In the following text, a variant of the embodiment shown in FIGS. 1 and 2 will be described in which, in the base part 9 of the piston 6, in the region of the sliding surface 10, an annular groove 36 is additionally formed, which is arranged coaxially with respect to the relief chamber 22 and is open toward the sliding bearing surface 11. This annular groove 36 is connected to a longitudinal groove 37 which is formed in the stroke ring 12 and which is open toward the sliding surface 10. This longitudinal groove 37 is offset with respect to the section plane of FIG. 3 (which extends at right angles to the axis of rotation 14*a* and in the center of the stroke ring 12) in the direction of the axis of rotation 14*a* of the drive shaft 14 and opens into the interior 5 of the pump casing 4 at both ends (FIG. 4). The seepage (lubricating oil) entering this annular groove 36 is led back into the interior 5 via the longitudinal groove 37.

As a result of the provision of the annular groove 36, the pressure distribution on the sliding surface 10 and the sliding bearing 37 in the radial direction toward the outside from the relief chamber 22 is changed, which has a beneficial influence on the amount of the seepage.

The second embodiment of a high pressure pump 1', shown in FIG. 5, differs from the first embodiment according to FIGS. 1–4 through a different configuration of the pressure transmission element arranged in the piston 6. In this FIG. 5, which in terms of illustration corresponds to FIG. 2, the same designations as in FIGS. 1–4 are used for parts which are the same in both embodiments.

In this second embodiment according to FIG. 5, the piston 6 comprises a piston element 38 guided in the cylinder bore 7 and a ring 39, which is firmly connected to the piston element 38 at the end of the latter facing away from the working chamber 8, for example by being pressed on or shrunk on. The ring 39 rests with a sliding surface 10 on the sliding bearing surface 11 on the stroke ring 12 and has a flange 40, on which the compression spring 17 is supported. As described by using FIGS. 1–3, this compression spring 17 ensures that the ring 39 remains in contact with the stroke ring 12. The sliding surface 10 is formed on the ring 39. The flange 40 could also be formed as a separate part, analogous to the bearing ring 16 of FIG. 2.

Arranged between the ring 39 and the piston element 38 is a diaphragm 41 which can be deflected elastically and is clamped firmly in a sealing manner along its edge region between the ring 39 and the piston element 38. This diaphragm 41, serving as a pressure transmission element, spans the relief chamber 22 delimited by the inner wall 39*a* of the ring and divides this relief chamber 22 from a chamber 42 formed in the piston element 38. Into this chamber 42 there opens a longitudinal bore 43, which extends in the direction of the longitudinal axis of the piston element 38 and via which the chamber 42 is connected to the working chamber 8. The longitudinal bore 43 and the chamber 42 form the passage 23. The chamber 42 is filled with the liquid to be delivered, that is to say with fuel.

The pressure in the chamber 42 changes in the same direction as the pressure in the working chamber 8. With increasing pressure in the chamber 42, the diaphragm 41 is deflected downward in the direction of the application of pressure, that is to say toward the sliding bearing surface 11. This leads to an increasing pressure in the relief chamber 22 containing lubricant, and therefore to hydrostatic pressure relief, as has already been described by using FIGS. 1–4. Since the pressures on both sides of the diaphragm 41 are virtually identical, the stressing of the diaphragm 41 is low. The latter can therefore be thin-walled and elastic.

In the variant according to FIG. 5, the annular groove 28 together with discharge conduit 30 for collecting and leading seepage away, present in the first exemplary embodiment according to FIGS. 1–3, is not shown but can likewise be provided if required.

In a further variant, not illustrated, the diaphragm 41 is fitted to the end surface 6*a* of the piston 6 facing away from the working chamber 8. The diaphragm 41 could be fixed by welding the same on or, in a manner analogous to that in FIG. 5, could be fixed with a screwed, pressed or shrunk retaining part. The passage 23 is then located underneath the diaphragm 41, it is filled with the lubricant and communicates directly with the relief chamber 22.

The action of the embodiment illustrated in FIG. 5 corresponds to the mode of operation described by using FIGS. 1–4.

The exemplary embodiments of a high pressure pump 1, 1' according to the invention, described in conjunction with FIGS. 1–5, have the advantage that, as a result of arranging a pressure transmission element, that is to say a control piston 25 or diaphragm 41, in the passage 23 connecting the working chamber 8 and the relief chamber 22, the media in the working chamber 8 and in the relief chamber 22 are separated from each other. This permits the use of a suitable lubricant in the region of the stroke ring 12 and of the crank drive 13, irrespective of the medium (fuel) to be delivered. In addition, without great constructional expenditure, the desired pressure relief of the sliding bearing which is formed by the sliding surface 10 of the piston 6 and the sliding bearing surface 11 on the stroke ring 12 is achieved.

It goes without saying that various variants of the exemplary embodiments shown are possible. Reference will be made to some of these variants below.

In a further embodiment, the piston 6 has no transverse bore 29. Because of the close sliding fit and the pressure relationships achieved according to the invention on both sides of the control piston 25, the leakage from the side facing the working chamber 8 into the relief chamber 22 can be kept very low.

Under certain circumstances, it is also possible to dispense with measures for collecting and discharging seepage along the outside of the piston 6, that is to say to dispense with the annular groove 28 and the discharge conduit 30 in the housing block 3, if no noticeable leakage occurs as a result of the prevailing pressure conditions.

In a further variant, not illustrated, the control piston 25 has a larger diameter than illustrated in FIGS. 1–3. The longitudinal bore 24 for guiding the control piston 25 with a close sliding fit can be open at the top in the direction of the working chamber 8. In this case, the part of the passage 23 which has a narrower cross section is again located under the control piston 25 and communicates directly with the relief chamber 22. The control piston 25 is installed in the piston 6 from above. A spring ring, analogous to the spring ring 27 according to FIG. 2, then prevents the control piston emerging above the end surface 6*a*. The longitudinal bore 24 can also be continuous in the piston 6. In this case, the remaining part of the passage 23 has the same diameter as the longitudinal bore 24. It is also conceivable to form the remaining section of the passage 23 slightly larger than the diameter of the longitudinal bore 24.

Furthermore, there is also a need to keep the lubrication losses from the relief chamber 22 into the interior 5 of the housing low. One means for this purpose is illustrated in the embodiment of FIGS. 3 and 4 (annular groove 36 and longitudinal groove 37). If the flat sliding surface 10 of the base part 9 and the sliding surface 11 of the stroke ring 12 do not rest exactly on each other, for example because of a forced skewed position of the two sliding surfaces 10 and 11, the lubrication losses are detrimentally affected. Constructional measures for preventing such a state can be: forming the base part 9 with a certain elasticity, such that the sliding surface 10 can adapt to the sliding surface 11 by means of slight elastic deformation of the base part 9. Division of base part 9 and piston 6 into two parts, in a manner analogous to that in DE-A-197 05 205 and the corresponding U.S. Pat. No. 6,077,056 in FIG. 4, can also be applied. In addition, the inner surface 12*a* of the stroke ring 12, together with the associated surface of the eccentric element 15, could be slightly convex in the direction of the axis of rotation 14*a* or even slightly spherical in the longitudinal and transverse direction. In this case, it is recommended to configure the stroke ring 12 in two parts for installation reasons.

Instead of two piston pump units 2, 2', as shown in FIG. 1, only one piston pump unit 2 can also be provided. Conversely, more than two piston pump units with corresponding sliding surfaces 11 of the stroke ring 12 can also be fitted radially, for example 3 piston pump units offset by 120°, or 4 offset by 90°, or 6 offset by 60°, with a common stroke ring 12.

In addition, it is also possible to arrange two or more individual piston pump units or two or more pairs of mutually opposite piston pump units 2, 2' operating in antiphase one after another in the direction of the axis of rotation 14*a* of the drive shaft 14.

Although the high-pressure pumps 1, 1' described are provided for use in fuel injection systems of internal combustion engines, in particular of diesel engines, these pumps can also find applications in other fields.

It is also possible to dispense with the compression spring 26 and the spring ring 27 supporting the latter. In this case, the control piston 25 is moved solely by the compressive forces acting on the two ends.

Finally, it is also possible to form the control piston 25 with two different diameters. Then, if the end face facing the working chamber 8 is larger than that facing the relief chamber, a step up in pressure takes place; in the opposite case a step down in pressure. In the case of these refinements, it may be advantageous to form the control piston 25 from two separate parts each having the appropriate diameter. If the bore having the correspondingly larger diameter and that having the correspondingly smaller diameter are not aligned exactly, tolerance and friction problems can be prevented in this way.

What is claimed is:

1. A high pressure pump, in particular for a fuel injection system for internal combustion engines, having at least one piston pump unit (2, 2') which has a piston (6) guided in a cylinder bore (7) and delimiting a working chamber (8), having a crank drive (13) for driving the piston (6), having a stroke ring (12) which is arranged between the crank drive (13) and the piston (6) and which is mounted such that it is driven rotatably with respect to the crank drive (13) but does not rotate and which has a flat sliding bearing surface (11), on which the piston (6) is supported with a sliding surface (10), and having a relief chamber (22) which is arranged in the region of the sliding surface (10), is open toward the sliding bearing surface (11) and which has a pressure connection to the working chamber (8) via a passage (23) formed in the piston (6), characterized in that in the passage (23) in the piston (6) there is arranged a pressure transmission element (25, 41), which can be pressurized on one side by the medium to be delivered and on the opposite side by a pressure medium in the relief chamber (22), can be displaced in the direction of the application of pressure under the action of pressure and separates the relief chamber (22) fluidically from the working chamber (8).

2. The high pressure pump as claimed in claim 1, wherein the crank drive (13) has an eccentric element (15) which is arranged on a rotatably driven drive shaft (14) with an eccentricity (e) and on which the stroke ring (12) is mounted such that it does not corotate.

3. The high pressure pump as claimed in claim 1, wherein the pressure transmission element is a control piston (25), which can be displaced in a longitudinal bore (24) belonging to the passage (23) and is guided closely in a sliding manner.

4. The high pressure pump as claimed in claim 3, wherein, on its end facing the relief chamber (22), the control piston (6) is supported on a compression spring (26) which rests on an abutment at the other end.

5. The high pressure pump as claimed in claim 4, wherein the abutment is formed by a supporting element retained in the control piston (25), in particular a spring ring (27).

6. The high pressure pump as claimed in claim 1, wherein the pressure transmission element is a diaphragm (41) which can be deflected elastically, which covers the passage (23) and is fixed in a sealing manner in its edge region.

7. The high pressure pump as claimed in claim 6, wherein the piston (6) has a piston element (38) guided in the longitudinal bore (7) and a ring (39) which is connected to the piston element (38) at the end of the latter facing away from the working chamber (8).

8. The high pressure pump as claimed in claim 7, wherein the diaphragm (41) is held firmly in its edge region between the piston element (38) and the ring (39).

9. The high pressure pump as claimed in claim 3, wherein in the piston (6) there is formed an annular groove (36) which surrounds the relief chamber (22) and is coaxial with the latter, which is open toward the sliding bearing surface (11) and which is connected to a chamber (5) in which the crank drive (13) and the stroke ring (12) are accommodated.

10. The high pressure pump as claimed in claim 9, wherein in the stroke ring (12), in the region of the sliding bearing surface (11), there is formed a longitudinal groove (37) which is open toward the sliding surface (10) and opens into the chamber (5), is offset with respect to the relief chamber (22) in the direction of the axis of rotation (14*a*) of the drive shaft (14) and communicates with the annular groove (36).

11. The high pressure pump as claimed in claim 1, wherein the pressure medium in the relief chamber (22) is a lubricant, preferably lubricating oil.

12. The high pressure pump as claimed in claim 11, wherein in the stroke ring (12) there is formed a connecting duct (34, 35), which opens into the sliding bearing surface (11) at a point such that it is connected to the relief chamber (22) only in specific positions of the stroke ring (12) with respect to the piston (6) and which can be connected periodically to a lubricant feed conduit (31, 32, 33).

13. The high pressure pump as claimed in claim 12, wherein, at the other end, the connecting duct (34, 35) opens into the inner surface (12*a*) of the stroke ring (12) which is in contact with the eccentric (15) of the crank drive (13), and in that on the circumference of the eccentric (15) there is provided a lubricating groove (31) which extends over part of its circumference and is open toward the outside and is connected to a lubricant source via a connecting line (32, 33) running in the eccentric (15) and in the drive shaft (14), the lubricating groove 31 being arranged such that it is connected to the connecting duct (34, 35) in the stroke ring (12) when this connecting duct (34, 35) is connected to the relief chamber (22).

14. The high pressure pump as claimed in claim 1, wherein in the wall of the cylinder bore (7) there is formed an annular collecting groove (28) which is open toward the piston (6), is used to collect seepage which passes through the gap between the wall of the cylinder bore (7) and the piston (6) and to which a discharge conduit (30) is connected.

15. The high pressure pump as claimed in claim 14, wherein in the piston (6) there is a transverse bore (29) which leads from the longitudinal bore (24) in the piston (6) to the outer wall of the latter, opens into the annular collecting groove (28) and is used to carry away seepage which passes through the gap between the wall of the longitudinal bore (24) and the control piston (25).

16. The high pressure pump as claimed in claim 1, wherein the high pressure pump (1, 1') is designed to deliver fuel, in particular diesel fuel.

17. The high pressure pump as claimed in claim 1, wherein the piston (6) is provided at its end opposite the working chamber (8) with a base part (9) in which the relief chamber (22) is formed.

18. The high pressure pump as claimed in claim 17, wherein the diameter of the relief chamber (22) is bigger than the diameter of the passage (23) in the piston (6).

19. The high pressure pump as claimed in claim 18, wherein the diameter of the relief chamber (22) is bigger than the diameter of a longitudinal bore (24) which is part of the passage (23).

20. The high pressure pump as claimed in claim 1, wherein the diameter of the passage (23) in the piston (6) is the same throughout the entire length of the passage (23).

* * * * *